US005720309A

United States Patent [19]

Baziuk

[11] Patent Number: 5,720,309

[45] Date of Patent: Feb. 24, 1998

[54] SEWER CLEANING NOZZLE

[75] Inventor: Morris Baziuk, Winnipeg, Canada

[73] Assignee: Flushquip Inc., Winnipeg, Canada

[21] Appl. No.: 721,030

[22] Filed: Sep. 26, 1996

[51] Int. Cl.[6] ..... B08B 3/02

[52] U.S. Cl. ..... 134/167 C; 134/168 C; 134/169 C; 134/172

[58] Field of Search ..... 134/167 C, 167 R, 134/169 C, 169 R, 168 R, 166 C, 172, 201, 168 C; 239/DIG. 13

[56] References Cited

U.S. PATENT DOCUMENTS

| | | | |
|---|---|---|---|
| 1,803,425 | 5/1931 | Cinningham | 134/167 C |
| 3,380,461 | 4/1968 | Maasberg et al. . | |
| 3,449,783 | 6/1969 | Kirschke | 134/167 R |
| 3,678,948 | 7/1972 | Hedges . | |
| 3,814,330 | 6/1974 | Masters . | |
| 4,073,302 | 2/1978 | Jones . | |
| 4,206,313 | 6/1980 | Cavoretto | 134/167 C |
| 4,699,163 | 10/1987 | Baziuk . | |
| 5,213,120 | 5/1993 | Dickson | 134/167 C |

FOREIGN PATENT DOCUMENTS

| | | | |
|---|---|---|---|
| 1729625 | 4/1992 | U.S.S.R. | 134/167 C |

*Primary Examiner*—Frankie L. Stinson

*Attorney, Agent, or Firm*—Adrian D. Battison; Murray E. Thrift

[57] ABSTRACT

A sewer cleaning nozzle is provided for attachment to a hose for supplying cleaning fluid through the hose to a number of nozzle tips carried on the nozzle body for providing a sweeping action for material collected in the sewer pipe as the nozzle is pulled forwardly by pulling on the supply hose. The nozzle body includes a central pipe portion and a rearwardly mounted chamber portion attached to the pipe portion. The chamber portion defines a radial front face carrying a plurality of nozzle tips at angularly spaced positions. A conical deflector within the chamber deflects cleaning water along the pipe portion outwardly of the chamber to a curved wall portion of the chamber causing the water to move smoothly around the chamber forwardly to the nozzle tips. Further nozzle tips are provided on the pipe portion having a reduced outward angle relative to the nozzle tips on the front face. A plurality of fins are attached to the pipe portion and the chamber lying in axial planes of the pipe portion with each fin being located between two of the nozzle tips. The fins are solid and imperforate and have inner edges immediately adjacent the chamber portion and the pipe portion.

20 Claims, 3 Drawing Sheets

SEWER CLEANING NOZZLE

This invention relates to a sewer cleaning nozzle of a type which is connected to a high pressure supply of cleaning fluid, particularly water, and includes high pressure jets directed rearwardly and outwardly relative to a central pipe section connected to an elongate hose so that as the nozzle is pulled through the sewer pipe it washes before it materials collected at the base of the pipe.

BACKGROUND OF THE INVENTION

One example of a nozzle of this type is shown in U.S. Pat. No. 4,699,163 of the present inventor which includes an elongate pipe section having a rear end for connection to the hose and a forward end connected to a cylindrical housing. At a rear face of the housing is provided a plurality of rearwardly extending jets surrounding the pipe section. A plurality of skid bars are attached to the housing longitudinally of the housing at angularly spaced positions around the housing with those skid bars extending from the rear face of the housing rearwardly and inwardly for attachment to the pipe section.

This arrangement of nozzle has achieved significant success in the field and is widely used but has a number of disadvantages. Firstly the nozzle tends to collect sticks and other elongate elements which lie transverse to the pipe so that they are carried by the nozzle and thus interfere with the proper sweeping action of the jets. Secondly the arrangement does not maximize water flow from the jets. Thirdly the construction is relatively complicated and therefore expensive.

Further examples are shown in U.S. Pat. No. 3,380,461 (Maasberg), U.S. Pat. No. 3,678,948 (Hedges assigned to Rockwell Manufacturing Co.); U.S. Pat. No. 3,814,330 (Masters assigned to McNeil Corporation) and U.S. Pat. No. 4,073,302 (Jones).

Masters shows a nozzle having four lobes each lying in a substantially axial plane with the lobes arranged at right angles and each lobe carries two jet nozzles. This arrangement is disadvantageous in that the nozzles are carried on the lobes and therefore can be engaged into the material at the base of the pipe thus reducing flow.

Maasberg discloses a head which is generally a flat body with nozzles at the front face. Again the nozzles can engage into the material reducing flow.

Hedges discloses a relatively complex arrangement with two heads carried on a central fin section with the fins welded to a connecting pipe section at spaced positions around the axis of the pipe section. This arrangement is relatively complex and bulky so that the cost of manufacture is increased and the proper flow of material and flushing water may not be achieved.

Jones discloses an arrangement with skids which run on the inside surface of the pipe with a simple nozzle and is therefore carried centrally of the pipe. This arrangement is impractical in view of the difficulty of running along the length of the pipe which can have obstructions, bends and the like.

SUMMARY OF THE INVENTION

It is one object of the present invention, therefore, to provide an improved sewer cleaning nozzle of the above general type.

According to one aspect of the invention there is provided a sewer cleaning nozzle comprising: a straight pipe portion having a longitudinal axis of the pipe portion defining a longitudinal direction of the nozzle; a first end of the pipe portion having thereon an attachment member for attachment to a cleaning fluid supply pipe; a chamber portion attached to a second end of the pipe portion having a front wall, a rear wall spaced axially of the front wall away from the first end, the front and rear walls each extending generally outwardly of the longitudinal axis, and a peripheral wall interconnecting the front and rear walls, the front wall facing along the pipe portion toward the first end thereof and the peripheral wall spaced radially outwardly relative to the pipe portion; a plurality of longitudinally extending fin members mounted on the pipe portion and the chamber portion at angularly spaced positions therearound, each fin member having an outer edge spaced radially outwardly relative to the peripheral wall of the chamber portion for supporting the peripheral wall in sliding action along a surface to be cleaned; a plurality of first jet cleaning nozzles mounted on the chamber portion at angularly spaced positions therearound, each arranged to define a stream of fluid projection forwardly and outwardly relative to the longitudinal axis, the first jet cleaning nozzles being located in between the fins; the pipe portion being in fluid connection with a chamber inside the chamber portion for supplying cleaning fluid thereto and the first jet cleaning nozzles each being in fluid connection with the chamber for receiving fluid therefrom; each fin having an inner edge having a first edge portion lying along the pipe portion and sufficiently closely thereto to avoid any substantial openings therebetween and a second edge portion lying along at least the front wall and peripheral wall of the chamber portion and sufficiently closely thereto to avoid any substantial openings therebetween, each of the fin members being substantially solid so as to avoid any substantial openings therein, Preferably the first jet cleaning nozzles are located on the front wall.

Preferably the front wall lies substantially in a radial plane of the longitudinal axis.

Preferably the second portion of each of the fin members also lies closely adjacent the rear wall.

Preferably the fin members are joined to a stub member rearwardly of the rear wall.

Preferably the stub member carries a fastening loop member.

Preferably the first jet cleaning nozzles each define an angle of the order of 15 degrees outwardly relative to the axis.

Preferably there is provided a conical baffle member inside the chamber having an apex lying on the axis and facing toward the first end and a base on the rear wall for guiding fluid flowing along the pipe portion outwardly from the axis toward the first jet cleaning nozzles.

Preferably the rear wall is curved outwardly of and forwardly from the base to curve the movement of the fluid outwardly and forwardly toward first jet cleaning nozzles.

Preferably there is provided a plurality of second nozzles mounted on the pipe portion forwardly of the front wall such that each defines a stream of fluid projection forwardly and outwardly relative to the longitudinal axis, the second jet cleaning nozzles being located at angularly spaced positions around the pipe portion in between the fins.

Preferably the second nozzles define an angle relative to the axis which is less than that of the first nozzles.

Preferably there is a number of the second nozzles which is less than that of the first nozzles.

Preferably the fins converge inwardly toward the first end and each end of each fin includes a curved end portions.

According to a second aspect of the invention there is provided a sewer cleaning nozzle comprising: a straight pipe portion having a longitudinal axis of the pipe portion defining a longitudinal direction of the nozzle; a first end of the pipe portion having thereon an attachment member for attachment to a cleaning fluid supply pipe; a chamber portion attached to a second end of the pipe portion having a front wall, a rear wall spaced axially of the front wall away from the first end, the front and rear walls each extending generally outwardly of the longitudinal axis, and a peripheral wall interconnecting the front and rear walls, the front wall facing along the pipe portion toward the first end thereof and the peripheral wall spaced radially outwardly relative to the pipe portion, the front wall lying substantially in a radial plane of the longitudinal axis; a plurality of longitudinally extending fin members mounted on the pipe portion and the chamber portion at angularly spaced positions therearound, each fin member having an outer edge spaced radially outwardly relative to the peripheral wall of the chamber portion for supporting the peripheral wall in sliding action along a surface to be cleaned; a plurality of first jet cleaning nozzles mounted on the front wall of the chamber portion at angularly spaced positions therearound, each arranged to define a stream of fluid projection forwardly and outwardly relative to the longitudinal axis, the first jet cleaning nozzles being located in between the fins; the pipe portion being in fluid connection with a chamber inside the chamber portion for supplying cleaning fluid thereto and the first jet cleaning nozzles each being in fluid connection with the chamber for receiving fluid therefrom; and a conical baffle member inside the chamber having an apex lying on the axis and facing toward the first end and a base on the rear wall for guiding fluid flowing along the pipe portion outwardly from the axis toward the first jet cleaning nozzles.

According to a third aspect of the invention there is provided a sewer cleaning nozzle comprising: a straight pipe portion having a longitudinal axis of the pipe portion defining a longitudinal direction of the nozzle; a first end of the pipe portion having thereon an attachment member for attachment to a cleaning fluid supply pipe; a chamber portion attached to a second end of the pipe portion having a front wall, a rear wall spaced axially of the front wall away from the first end, the front and rear walls each extending generally outwardly of the longitudinal axis, and a peripheral wall interconnecting the front and rear walls, the front wall facing along the pipe portion toward the first end thereof and the peripheral wall spaced radially outwardly relative to the pipe portion, the front wall lying substantially in a radial plane of the longitudinal axis; a plurality of longitudinally extending fin members mounted on the pipe portion and the chamber portion at angularly spaced positions therearound, each fin member having an outer edge spaced radially outwardly relative to the peripheral wall of the chamber portion for supporting the peripheral wall in sliding action along a surface to be cleaned; a plurality of first jet cleaning nozzles mounted on the front wall of the chamber portion at angularly spaced positions therearound, each arranged to define a stream of fluid projection forwardly and outwardly relative to the longitudinal axis, the first jet cleaning nozzles being located in between the fins; ction with a chamber inside the chamber portion for supplying cleaning fluid thereto and the first jet cleaning nozzles each being in fluid connection with the chamber for receiving fluid therefrom; a plurality of second nozzles mounted on the pipe portion forwardly of the front wall such that each defines a stream of fluid projection forwardly and outwardly relative to the longitudinal axis, the second jet cleaning nozzles being located at angularly spaced positions around the pipe portion in between the fins, the second nozzles defining an angle relative to the axis which is less than that of the first nozzles.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
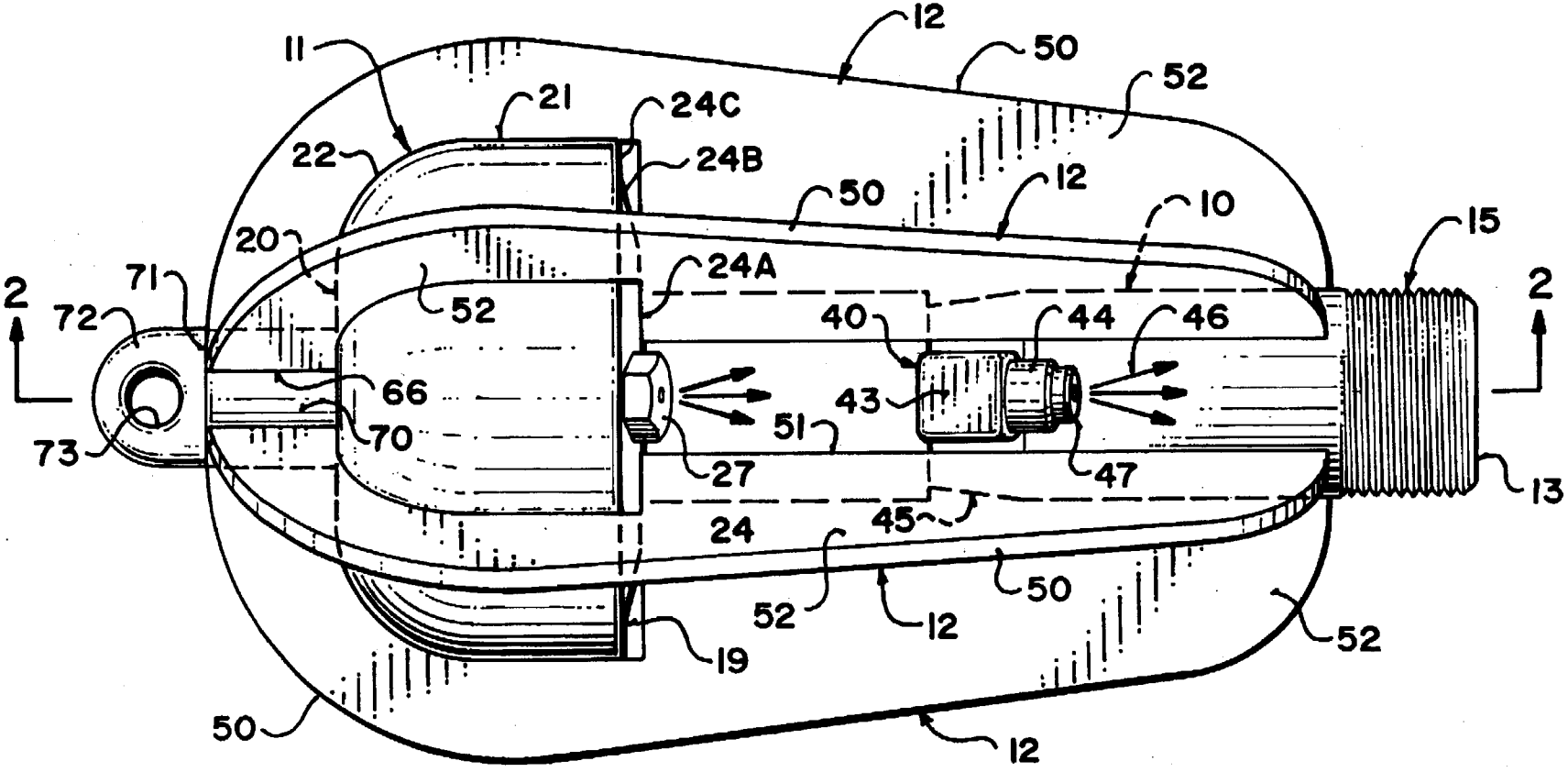
FIG. 1 is a top plan view of a jet clean nozzle according to the present invention.
Figure 2:
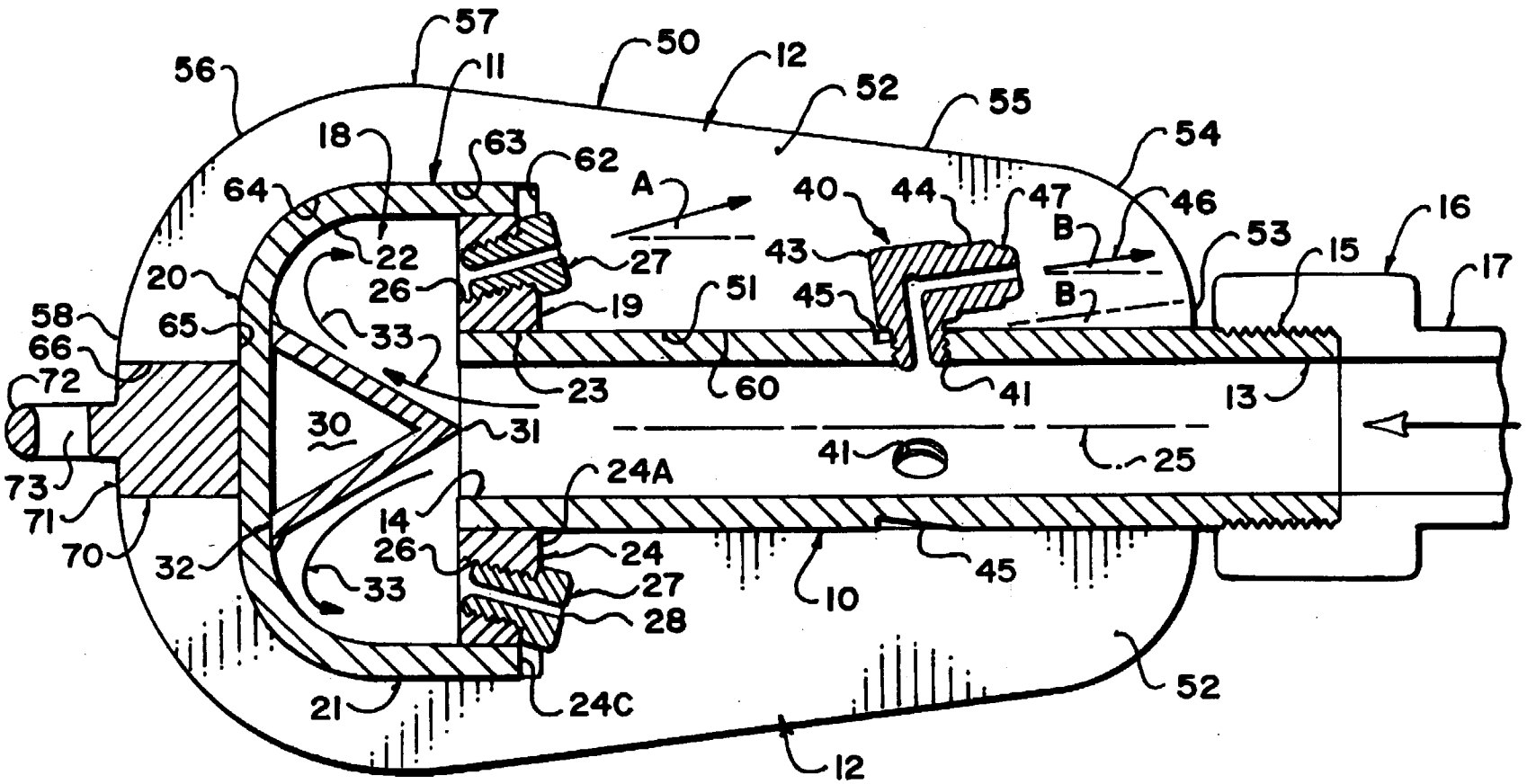
FIG. 2 is a horizontal cross sectional view through the nozzle of FIG. 1.
Figure 3:
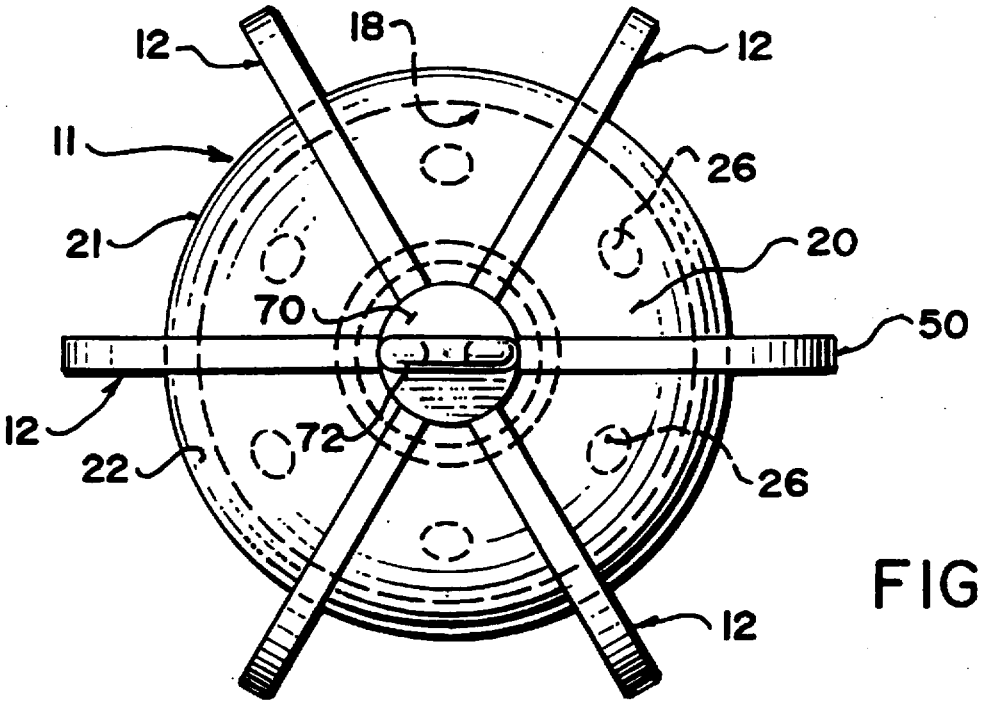
FIG. 3 is a first end elevational view of the nozzle of FIG. 1.

The cleaning nozzle shown in the drawings comprises an elongate pipe portion 10, a head portion 11 and a plurality of fins 12.

The pipe portion 10 comprises an elongate rigid straight pipe having a rear end 13 and a forward end 14. The pipe is relatively short generally of the order of six inches in length and has its rearward end 13 a threaded outer surface 15 for receiving a coupling 16 of a supply hose 17.

The head portion 11 defines an internal chamber 18 connected to the interior of the pipe portion 10 for receiving a cleaning fluid supplied therefrom supplied through the hose 17. The chamber includes a front wall 19 facing the first end 13 of the pipe portion, a rear wall 20 generally parallel to the front wall and spaced axially therefrom and a peripheral wall 21 interconnecting the front and rear walls. In the examples shown the rear wall 20 and the peripheral wall 21 are formed integrally from a single metal element which is shaped with a curved interconnecting portend 22 joining the peripheral wall to the rear wall. The front wall 19 is formed by a separate element which is annular in shape so as to surround the end 14 of the pipe portion and so as to be located inside the forward end of the peripheral wall portion 21. The front wall 19 is welded at its outer edge to the front portion of the peripheral wall with a high pressure welding technique so as to define a high pressure chamber for receiving the high pressure liquid from the hose 17. The inside edge 23 of the front wall 19 is welded to the end 14 of the pipe portion, again with a pressure weld so that the whole of the interior of the pipe portion and the interior of the chamber can accommodate the high pressure from the cleaning liquid within the supply pipe 17.

Figure 4:
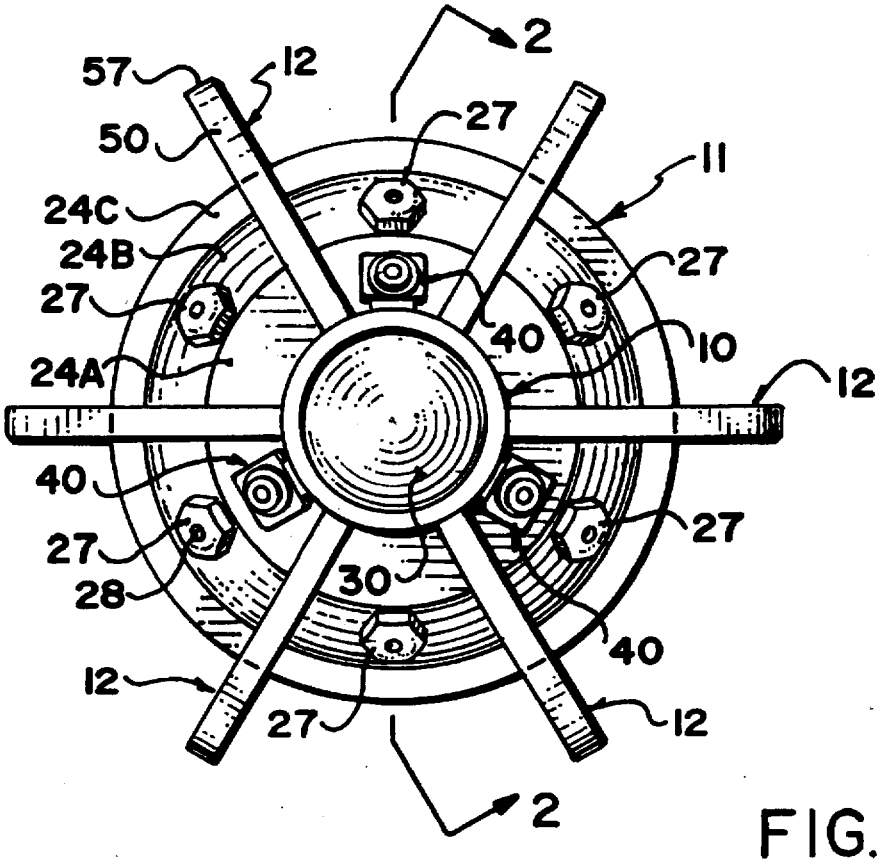
FIG. 4 is a second elevational view of the nozzle of FIG. 1.

The front wall 19 include a front surface 24 which lies generally in a radial plane of the axis 25 of the pipe portion. The front surface 24 includes an inner portion 24A which lies directly in the radial plane, an intermediate inclined portion 24B which is inclined so that it faces slightly outwardly away from the axis 25 at an outermost portion 24C which is again in a directly radial plane recessed slightly relative to the inner portion 24A. The inclined portion 24B is thus set at an angle to receive therethrough a series of drilled holes 26 each of which receives a jet nozzle 27 defining a jet orifice 28. The angle of the surface portion 24B is thus set that the hole 26 lies at right angles to the surface. The angle is arranged so that each jet nozzle 28 provides an angle A relative to a line parallel to the axis which is of the order of 15° outwardly of the axis. As shown in FIG. 4 there are six such holes and associated jet nozzles at equi-angular spaced positions around the axis 25.

Inside the chamber 18 is located a conical deflector member 30 having an apex 31 and a base 32. The deflector member 30 is attached to the rear wall 20 so that the base 32 is welded to the front face of the rear wall with the deflector member and the apex projecting forwardly therefrom, The deflector member is located centrally of the rear wall 20 so that the apex 31 lies on the axis 25 and faces longitudinally of the pipe portion toward the feed tube 17. The apex is located substantially at or adjacent the entrance to the chamber that is at the rear end 14 of the pipe portion.

The deflector member 30 acts to deflect cleaning fluid indicated at arrow 33 from the pipe portion along the front face of the conical deflector member so that the liquid is prevented from impacting the front surface of the rear wall 20 but is instead deflected outwardly toward the curved connector portion 22. The liquid thus passes smoothly from the outside surface of the deflector onto the front surface of the rear wall 20 adjacent the curved connector portion in view of the increased angle of incidents of a liquid on the rear wall. The curved connector portion also acts to curve the movement of the liquid outwardly and forwardly so that the liquid is moving forwardly to a position where it reaches the front wall and particularly the jet nozzles 27. The jet nozzles are arranged substantially immediately adjacent the inside surface of the peripheral wall so that the liquid can flow smoothly into the holes 26 to enter the orifices 28. This arrangement therefore provides a smoother flow of the liquid in its high pressure high velocity movement from the rearward moving liquid in the pipe portion to the forwardly moving liquid at the outlet jet nozzles 27.

On the pipe portion 10 is also mounted a plurality of second nozzles 40 which are connected on the pipe portion approximately halfway along the pipe portion that is forward of the front face 24 and rearward of the front coupling 15. Each nozzle is engaged into a respective one of three holes 41 provided in the pipe portion and each nozzle comprises a cylindrical connection portion 42 having a threaded surface engaged into the respective hole 41. An elbow 43 is connected to the upper end of the connection portion 42, the elbow having a forwardly extending portion 44. A band 45 is machined into the outside surface of the pipe portion so as to define a slightly inclined surface at which the holes 41 are located. The holes are arranged so that they lay at right angles to the surface 45 and thus the holes have a slight inclination of the axis of the hole thus locating the connection portion 42 at a slight angle. As the elbow is a 90°, the forwardly projecting portion 44 lies at an angle slightly outwardly of the axis 25 thus defining the same angle for an outlet jet 46 of a nozzle tip 47 engaged into the forwardly projecting portion 44. The angle of the jet 46 relative to the axis which is the same angle B as the surface 45 to the axis is arranged to be less than that of the angle A and preferably of the order of 5° to 10°.

The fins 12 are arranged so that the number of fins is equal to the number of nozzles 27 so that each nozzle is symmetrically located between a respective pair of the pins. The number of the nozzles 40 is reduced relative to the number of nozzles 27 and is preferably one half of that number so that there are three such nozzles 40 each located between alternate pairs of the fins.

The fins 12 are arranged so that the each fin lies in an axial plane of the axis 25 with the fins being at equi-angularly spaced positions around the axis 25. Each fin is formed from a plate of metal defining an outer edge 50, an inner edge 51 and two side surfaces 52. The outer edge 50 is shaped so that the forward end 53 of the fin is located immediately rearwardly of the coupling portion 15. At that position the outer edge 50 extends substantially at right angles to the axis of the pipe portion following which the outer edge provides a smoothly curved section 54 which curves rearwardly and intersects with a straight edge 55 which is inclined so that the straight edges 55 lie on a cone tapering inwardly toward the front of the nozzle. At a rear end of the straight edge 55 is provided a smoothly curved rear section 56 which extends from the larger end 57 of the straight portion 55 inwardly to a rear most end 58 which again lies substantially at right angles to the axis 25.

The inner edge 51 includes a portion which lies substantially directly along the outside surface of the pipe portion 10. That first portion 60 of the inner edge along the pipe portion is thus straight and lies in contact with or immediately adjacent the outside surface of the pipe portion. At the front face 24, the inner edge 51 includes a radially outwardly extending portion 62 which extends outwardly to a third portion 63 of the inner edge which lies immediately adjacent or in contact with the peripheral wall 21. The third portion 63 includes a curved section 64 following the curvature of the portion 22 and a rear portion 65 lying along the rear face of the rear wall 20. A final portion 66 of the inner edge is attached to a stub member 70 welded to and extending rearwardly from the rear surface of the rear wall 20. On the rear face 71 of the stub member 70 is provided a loop 72 with the hole 73 for attachment for example to a pulling cord of a camera.

Each fin is thus formed by a plate of metal so that it is solid and imperforate with no holes for catching or attracting materials within the pipe. The inner edge of the fin lies immediately adjacent the respective part of the pipe portion or chamber portion so that there is again no possibility of materials being collected in any openings therebetween.

In operation, the supply of cleaning liquid, generally water through the tube 17 provides a flow of the cleaning fluid through the nozzles 27 and 40. This flow is sufficient to cause the nozzle to slide along a pipe to be cleaned pulling the hose 17 behind the nozzle. When the nozzle has reached the end of the section to be cleaned, a forward movement is halted and the hose 17 is pulled thus pulling the nozzle against its initial direction. The forward nozzles 40 act as pushing nozzles which push water and initial material forwardly thus sweeping that collected water forwardly as the nozzle moves forwardly pulled by the hose 17. The nozzles 27 thus are able to act directly upon collected material sitting on the bottom of the pipe in a vigorous washing action which thus breaks up mud, stones and other collected materials and pushes that material forwardly into the area where the pushing nozzles 40 can again direct that material forwardly along the pipe.

The conical shape of the outer edges of the fins causes the nozzle to lie with the fines which are at the bottom (depending upon the angular orientation of the nozzle which can of course vary) lying flat against the bottom of the sewer pipe. This tends to direct those nozzles which are at the bottom at a sharper angle outwardly to the pipe wall while the nozzles that are at the top tend to direct material along the axis of the sewer pipe thus increasing the aggressiveness of the washing action at the bottom of the pipe while increasing the pushing action of materials in the pipe along the pipe to the area for collection. Also the conical shape of the fins allows the device to more easily ride over any impacted material in the pipe.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A sewer cleaning nozzle comprising:

a straight pipe portion having a longitudinal axis of the pipe portion defining a longitudinal direction of the nozzle;

a first end of the pipe portion having thereon an attachment member for attachment to a cleaning fluid supply pipe;

a chamber portion attached to a second end of the pipe portion having a front wall, a rear wall spaced axially of the front wall away from the first end, the front and rear walls each extending generally outwardly of the longitudinal axis, and a peripheral wall interconnecting the front and rear walls, the front wall facing along the pipe portion toward the first end thereof and the peripheral wall spaced radially outwardly relative to the pipe portion;

a plurality of longitudinally extending fin members mounted on the pipe portion and the chamber portion at angularly spaced positions therearound, each fin member having an outer edge spaced radially outwardly relative to the peripheral wall of the chamber portion for supporting the peripheral wall in sliding action along a surface to be cleaned;

a plurality of first jet cleaning nozzles mounted on the chamber portion at angularly spaced positions therearound, each arranged to define a stream of fluid projection forwardly and outwardly relative to the longitudinal axis, the first jet cleaning nozzles being located in between the fins;

the pipe portion being in fluid connection with a chamber inside the chamber portion for supplying cleaning fluid thereto and the first jet cleaning nozzles each being in fluid connection with the chamber for receiving fluid therefrom;

each fin having an inner edge having a first edge portion lying along the pipe portion and sufficiently closely thereto to avoid any substantial openings therebetween and a second edge portion lying along at least the front wall and peripheral wall of the chamber portion and sufficiently closely thereto to avoid any substantial openings therebetween, each of the fin members being substantially solid so as to avoid any substantial openings therein.

2. The nozzle according to claim 1 wherein the first jet cleaning nozzles are located on the front wall.

3. The nozzle according to claim 2 wherein the front wall lies substantially in a radial plane of the longitudinal axis.

4. The nozzle according to claim 1 wherein the second portion of each of the fin members also lies closely adjacent the rear wall.

5. The nozzle according to claim 1 wherein the fin members are joined to a stub member rearwardly of the rear wall.

6. The nozzle according to claim 1 wherein the stub member carries a fastening loop member.

7. The nozzle according to claim 1 wherein first jet cleaning nozzles each define an angle of the order of 15 degrees outwardly relative to the axis.

8. The nozzle according to claim I wherein there is provided a conical baffle member inside the chamber having an apex lying on the axis and facing toward the first end and a base on the rear wall for guiding fluid flowing along the pipe portion outwardly from the axis toward the first jet cleaning nozzles.

9. The nozzle according to claim 8 wherein the rear wall is curved outwardly of and forwardly from the base to curve the movement of the fluid outwardly and forwardly toward first jet cleaning nozzles.

10. The nozzle according to claim 8 wherein there is provided a plurality of second nozzles mounted on the pipe portion forwardly of the front wall such that each defines a stream of fluid projection forwardly and outwardly relative to the longitudinal axis, the second jet cleaning nozzles being located at angularly spaced positions around the pipe portion in between the fins.

11. The nozzle according to claim 10 wherein the second nozzles define an angle relative to the axis which is less than that of the first nozzles.

12. The nozzle according to claim 10 wherein there is a number of the second nozzles which is less than that of the first nozzles.

13. The nozzle according to claim 8 wherein the fins converge inwardly toward the first end and each end of each fin includes a curved end portions.

14. A sewer cleaning nozzle comprising:

a straight pipe portion having a longitudinal axis of the pipe portion defining a longitudinal direction of the nozzle;

a first end of the pipe portion having thereon an attachment member for attachment to a cleaning fluid supply pipe;

a chamber portion attached to a second end of the pipe portion having a front wall, a rear wall spaced axially of the front wall away from the first end, the front and rear walls each extending generally outwardly of the longitudinal axis, and a peripheral wall interconnecting the front and rear walls, the front wall facing along the pipe portion toward the first end thereof and the peripheral wall spaced radially outwardly relative to the pipe portion, the front wall lying substantially in a radial plane of the longitudinal axis;

a plurality of longitudinally extending fin members mounted on the pipe portion and the chamber portion at angularly spaced positions therearound, each fin member having an outer edge spaced radially outwardly relative to the peripheral wall of the chamber portion for supporting the peripheral wall in sliding action along a surface to be cleaned;

a plurality of first jet cleaning nozzles mounted on the front wall of the chamber portion at angularly spaced positions therearound, each arranged to define a stream of fluid projection forwardly and outwardly relative to the longitudinal axis, the first jet cleaning nozzles being located in between the fins;

the pipe portion being in fluid connection with a chamber inside the chamber portion for supplying cleaning fluid thereto and the first jet cleaning nozzles each being in fluid connection with the chamber for receiving fluid therefrom;

and a conical baffle member inside the chamber having an apex lying on the axis and facing toward the first end and a base on the rear wall for guiding fluid flowing along the pipe portion outwardly from the axis toward the first jet cleaning nozzles.

15. The nozzle according to claim 14 wherein first jet cleaning nozzles each define an angle of the order of 15 degrees outwardly relative to the axis.

16. The nozzle according to claim 14 wherein the rear wall is curved outwardly of and forwardly from the base to curve the movement of the fluid outwardly and forwardly toward the first jet cleaning nozzles.

17. The nozzle according to claim 14 wherein there is provided a plurality of second nozzles mounted on the pipe portion forwardly of the front wall such that each defines a stream of fluid projection forwardly and outwardly relative to the longitudinal axis, the second jet cleaning nozzles being located at angularly spaced positions around the pipe portion in between the fins.

18. The nozzle according to claim 17 wherein the second nozzles define an angle relative to the axis which is less than that of the first nozzles.

19. A sewer cleaning nozzle comprising:

a straight pipe portion having a longitudinal axis of the pipe portion defining a longitudinal direction of the nozzle;

a first end of the pipe portion having thereon an attachment member for attachment to a cleaning fluid supply pipe;

a chamber portion attached to a second end of the pipe portion having a front wall, a rear wall spaced axially of the front wall away from the first end, the front and rear walls each extending generally outwardly of the longitudinal axis, and a peripheral wall interconnecting the front and rear walls, the front wall facing along the pipe portion toward the first end thereof and the peripheral wall spaced radially outwardly relative to the pipe portion, the front wall lying substantially in a radial plane of the longitudinal axis;

a plurality of longitudinally extending fin members mounted on the pipe portion and the chamber portion at angularly spaced positions therearound, each fin member having an outer edge spaced radially outwardly relative to the peripheral wall of the chamber portion for supporting the peripheral wall in sliding action along a surface to be cleaned;

a plurality of first jet cleaning nozzles mounted on the front wall of the chamber portion at angularly spaced positions therearound, each arranged to define a stream of fluid projection forwardly and outwardly relative to the longitudinal axis, the first jet cleaning nozzles being located in between the fins;

the pipe portion being in fluid connection with a chamber inside the chamber portion for supplying cleaning fluid thereto and the first jet cleaning nozzles each being in fluid connection with the chamber for receiving fluid therefrom;

a plurality of second nozzles mounted on the pipe portion forwardly of the front wall such that each defines a stream of fluid projection forwardly and outwardly relative to the longitudinal axis, the second jet cleaning nozzles being located at angularly spaced positions around the pipe portion in between the fins, the second nozzles defining an angle relative to the axis which is less than that of the first nozzles.

20. The nozzle according to claim 19 wherein there is a number of the second nozzles which is less than that of the first nozzles.

* * * * *